US008939385B2

(12) United States Patent
Huffman et al.

(10) Patent No.: US 8,939,385 B2
(45) Date of Patent: Jan. 27, 2015

(54) MANIFOLD SPRAYING SYSTEM WITH IMPROVED MOUNTING ASSEMBLY

(75) Inventors: David Clark Huffman, Merrimack, NH (US); Rick H. Knapp, Nashua, NH (US); Maurice Ovide Brisson, Hooksett, NH (US)

(73) Assignee: Spraying Systems Co., Wheaton, IL (US)

( * ) Notice: Subject to any disclaimer, the term of this patent is extended or adjusted under 35 U.S.C. 154(b) by 1084 days.

(21) Appl. No.: 12/997,007

(22) PCT Filed: Jun. 11, 2009

(86) PCT No.: PCT/US2009/047032

§ 371 (c)(1),
(2), (4) Date: Dec. 9, 2010

(87) PCT Pub. No.: WO2009/152324

PCT Pub. Date: Dec. 17, 2009

(65) Prior Publication Data

US 2011/0079666 A1 Apr. 7, 2011

Related U.S. Application Data

(60) Provisional application No. 61/061,009, filed on Jun. 12, 2008.

(51) Int. Cl.
*B05B 1/20* (2006.01)
*B05B 15/06* (2006.01)
(Continued)

(52) U.S. Cl.
CPC ..... *B05B 7/0884* (2013.01); *B05B 15/061* (2013.01); *B05B 15/08* (2013.01); *B05B 15/069* (2013.01)
USPC ..... 239/268; 239/266; 239/273; 239/282; 239/283; 239/548; 239/566; 239/600

(58) Field of Classification Search
CPC ..... B05B 1/20; B05B 1/202; B05B 1/205; B05B 15/06; B05B 15/061; B05B 15/064; F16B 2/02; F16B 2/04; F16B 2/10; F16B 7/0433
USPC ..... 239/266, 282, 283, 543, 548, 550, 556, 239/557, 587.1, 587.2, 587.5, 600; 248/62, 248/74.1, 81, 82, 84, 124.2, 213.4, 229.1, 248/643, 540, 58, 226.11, 229.13, 229.23, 248/230.4, 231.51
See application file for complete search history.

(56) References Cited

U.S. PATENT DOCUMENTS 3,827,637 A 8/1974 Stephany et al.
3,963,855 A 6/1976 Hawkins et al.
(Continued)

*Primary Examiner* — Melanie Tyson
*Assistant Examiner* — Thomas Berez
(74) *Attorney, Agent, or Firm* — Leydig, Voit & Mayer, Ltd.

(57) ABSTRACT

A mounting system for a spray manifold having a plurality of spray modules arranged in a lateral array with support assemblies between adjacent modules. The mounting arrangement includes one or more mounting assemblies which each have a hub that is securable about one of the manifold support assemblies and a clamp comprising a pair of clamping arms that is securable about the hub by means of an appropriate fastener. The hub and clamping arms define complementary circular surfaces which permit the selected pivotal positioning of the hub and the spray manifold to which it is secured relative to the clamp and a machine mounting structure.

4 Claims, 4 Drawing Sheets

(51) Int. Cl.

| | |
|---|---|
| ***B05B 1/14*** | (2006.01) |
| ***B05B 7/08*** | (2006.01) |
| ***B05B 15/08*** | (2006.01) |

(56) References Cited

U.S. PATENT DOCUMENTS

| | | | | |
|---|---|---|---|---|
| 4,252,289 | A * | 2/1981 | Herb | 248/62 |
| 4,257,559 | A | 3/1981 | Noren | |
| 5,280,855 | A * | 1/1994 | Rietsch, Jr. | 239/264 |
| 5,942,037 | A * | 8/1999 | Wagener et al. | 118/315 |
| 6,386,786 | B1 | 5/2002 | Perlman et al. | |
| 6,595,473 | B2 * | 7/2003 | Aoki et al. | 248/74.4 |
| 6,739,526 | B2 * | 5/2004 | Wlodarczyk | 239/551 |
| 6,755,445 | B2 * | 6/2004 | Balamuta et al. | 285/357 |
| 6,892,990 | B2 * | 5/2005 | Pisczak | 248/74.4 |
| 6,968,864 | B2 * | 11/2005 | Miyamoto et al. | 138/110 |
| 7,083,121 | B2 * | 8/2006 | Huffman | 239/398 |
| 2002/0139300 | A1 * | 10/2002 | Wlodarczyk | 118/302 |
| 2004/0065752 | A1 * | 4/2004 | Mather et al. | 239/261 |
| 2004/0135040 | A1 * | 7/2004 | Eason | 248/122.1 |

* cited by examiner

MANIFOLD SPRAYING SYSTEM WITH IMPROVED MOUNTING ASSEMBLY

CROSS-REFERENCE TO RELATED APPLICATIONS

This patent application claims the benefit of U.S. Provisional Patent Application No. 61/061,009, filed Jun. 12, 2008, which is incorporated by reference.

BACKGROUND OF THE INVENTION

Spray gun manifold assemblies that include a plurality of laterally spaced spray guns supported in a row for discharging an elongated spray pattern are known. One application for such manifolds is coating machines for use in coating food and pharmaceutical products. In such applications, a particular coating machine can be used to coat products having a variety of different shapes and sizes. The number of products that must be coated can also vary. Based on the size, shape or number of products being coated, it may be desirable to adjust the positioning of the spray gun manifold in order to ensure that the products are properly coated and to minimize wasteful overspray that does not contact the products being coated. While some spray gun manifolds are mounted in such a manner that their position can be adjusted, their adjustability can be limited to a narrow range. Additionally, the known mounting arrangements are not particularly adaptable to different applications and products. Another drawback with the known mounting arrangements is that they are very difficult to clean.

BRIEF DESCRIPTION OF THE SEVERAL VIEWS OF THE DRAWING(S)

DETAILED DESCRIPTION OF THE INVENTION

Figure 1:
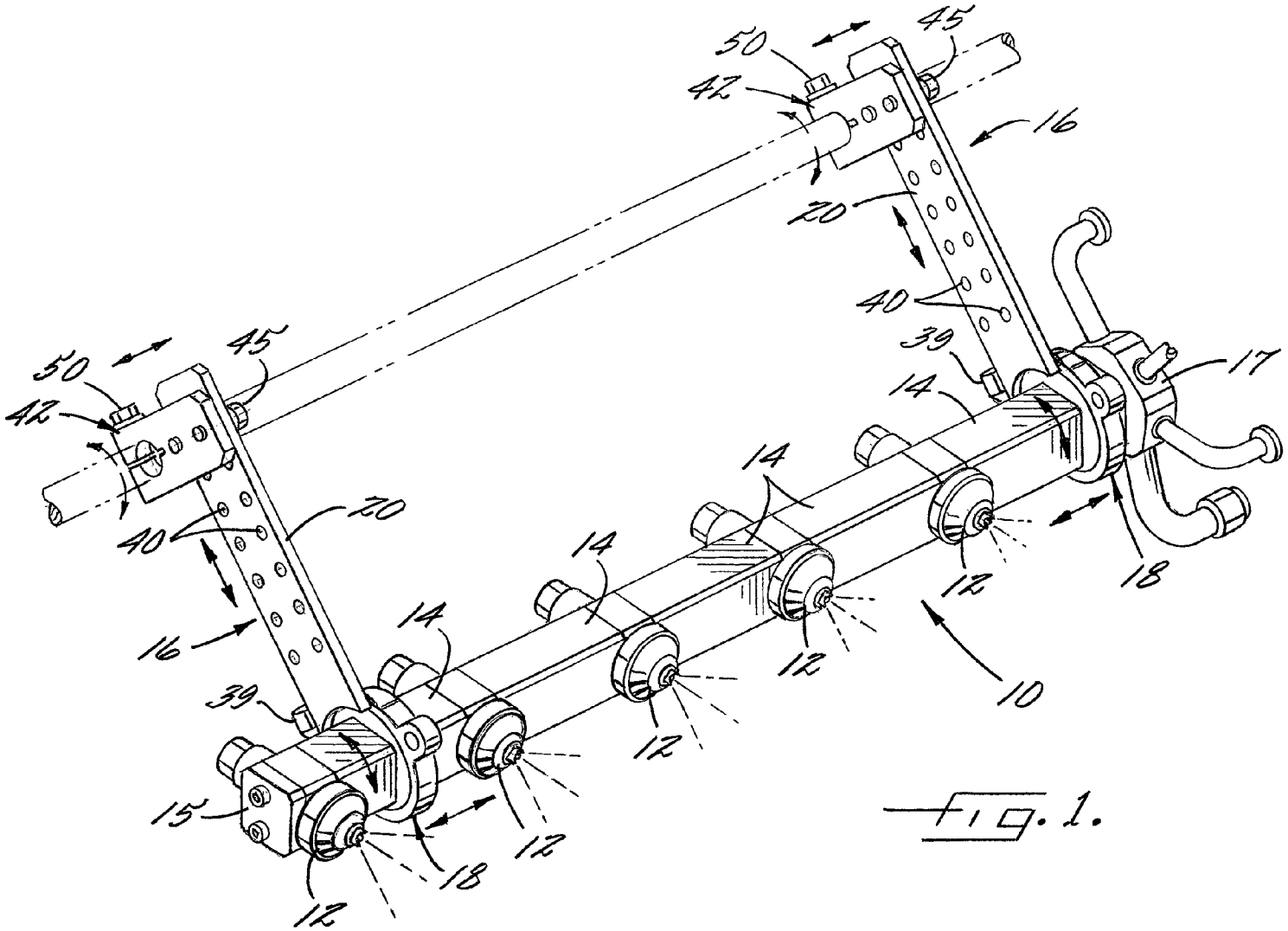
FIG. 1 is a perspective view of an exemplary spray gun manifold having a mounting assembly constructed in accordance with the present invention.

Referring now more particularly to FIG. 1 of the drawings there is shown an illustrative embodiment of a spray gun manifold 10 having a mounting assembly 16 according to the present invention. The manifold 10 has a modular configuration that includes a plurality of spray gun modules 12 each of which includes a rectangular block-shaped body, a spray nozzle assembly supported at one end of the module body, and an actuator supported at the opposite end of the module body. The basic structure and mode of operation of the spray gun modules 12 are known in the art, for example, as shown in U.S. Pat. No. 5,707,010 assigned to the same assignee of the present application, the disclosure of which is incorporated herein by reference. The overall structure and mode of operation of the spray gun modules 12 should be understood to be illustrative of only one example of spray device with which the present invention may be used. The present invention will be described in connection with a coating machine such as used to apply coatings to pharmaceutical and food products. However, those skilled in the art will appreciate that the present invention is not limited to use in such applications.

The spray gun modules 12 are interconnected in laterally spaced apart relation by fluid communication and support assemblies 14 interposed between adjacent spray gun modules. The support assemblies 14 in this case include a plurality of fluid conduits for supplying liquid, atomizing air, cylinder air, and control air to corresponding passages in the spray gun module bodies. In the illustrated embodiment, the support assemblies 14 comprise blocks within which the fluid conduits are embedded or extend. Preferably, the blocks are made of a relatively lightweight material such as Teflon® or the like. In the illustrated embodiment, one end of the manifold 10 is closed by an end plate 15 that could be configured with fluid return passages while the other end of the manifold includes a fluid connection flange 17 that includes a plurality of fluid connections to which respective fluid lines can be connected. Additional details regarding the construction of the manifold 10 can be found in U.S. Pat. No. 7,083,121, which is assigned to the assignee of the present invention and the disclosure of which is incorporated herein by reference. As will be appreciated by those skilled in the art, the illustrated modular manifold 10 is only one example of spray device with which the present invention may be used.

In accordance with an aspect of the present invention, the modular spray gun manifold 10 has an associated mounting assembly 16 that supports the manifold while allowing the position or orientation of the manifold, including the spray gun modules 12, to be adjusted very quickly and easily across a wide range of different positions relative to the product being coated. The flexibility of the mounting assembly 16 also enables the manifold 10 to be easily adapted to different applications. Moreover, the mounting assembly 16 is easy to install in connection with both new installations and retrofits to existing applications. To this end, the illustrated mounting assembly 16 includes a clamp and hub assembly 18 for connection to one of the support assemblies 14 of the manifold 10. The clamp and hub assembly 18, in turn, is supported by an arm 20 that is connectable to a support structure associated with the coating machine to thereby support the manifold 10 within the coating machine.

In the case of the illustrated embodiment, a pair of mounting assemblies 16 are provided so as to enable the manifold 10 to be supported at two different locations. As will be appreciated by those skilled in the art, the number and location of mounting assemblies 16 that may be required will vary between applications and will depend on, among other things, the length and weight of the manifold 10. For instance, some applications involving particularly lengthy or heavy manifolds may require more than two mounting assemblies. Conversely, particularly short or lightweight manifolds may only require a single mounting arrangement. Accordingly, the present invention is not limited to any particular number of mounting arrangements.

In this case, the clamp and hub assembly 18 includes a hub 22 arranged inside of a clamp 24 (see, e.g., FIG. 2), which has an annular configuration, such that the hub is rotatable relative to the clamp. Moreover, to facilitate connection of the clamp and hub assembly 18 to the manifold 10, both have a two-piece construction. In particular, the hub 22 is divided into first and second halves 26, 27 that can be connected together using fasteners, in this case two bolts 28. The clamp 24 also comprises first and second parts 30, 31 that in this instance are pivotably connected to each other by a hinge such that the first and second parts can swing relative to each other between open and closed positions. The two part constructions of the hub 22 and clamp 24 make it easy to disassemble the system for cleaning operations, which is a particular concern in coating operations involving pharmaceutical and food products. According to one embodiment of the invention, the hub 22 and clamp 24 are both made of stainless steel.

Figure 2:
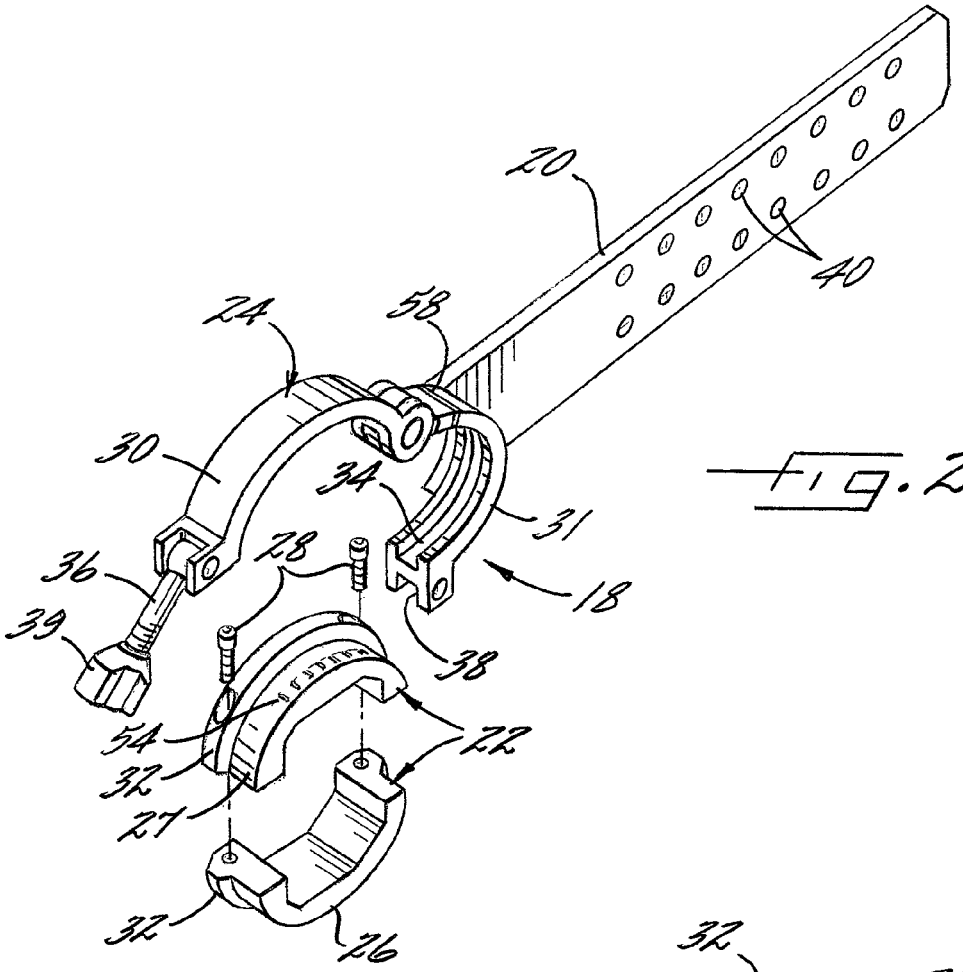
FIG. 2 is a partially exploded perspective view of the clamp and hub assembly of the mounting assembly of FIG. 1.
Figure 3:
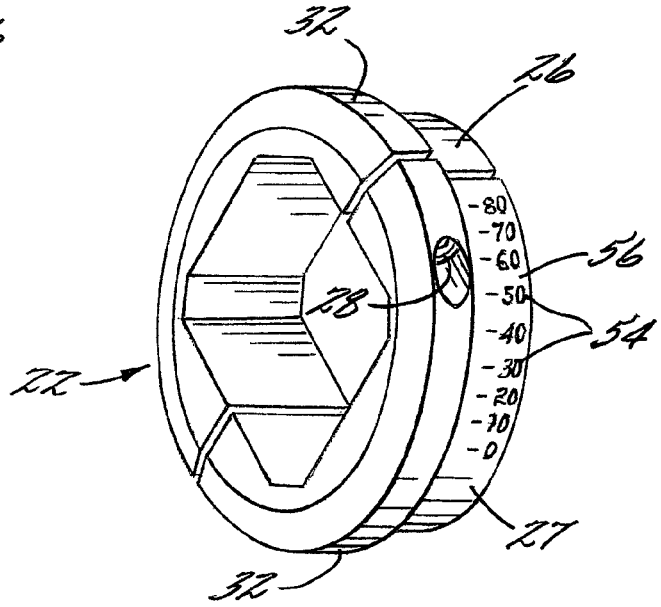
FIG. 3 is a perspective view of the hub of the mounting assembly of FIG. 1.
Figure 4:
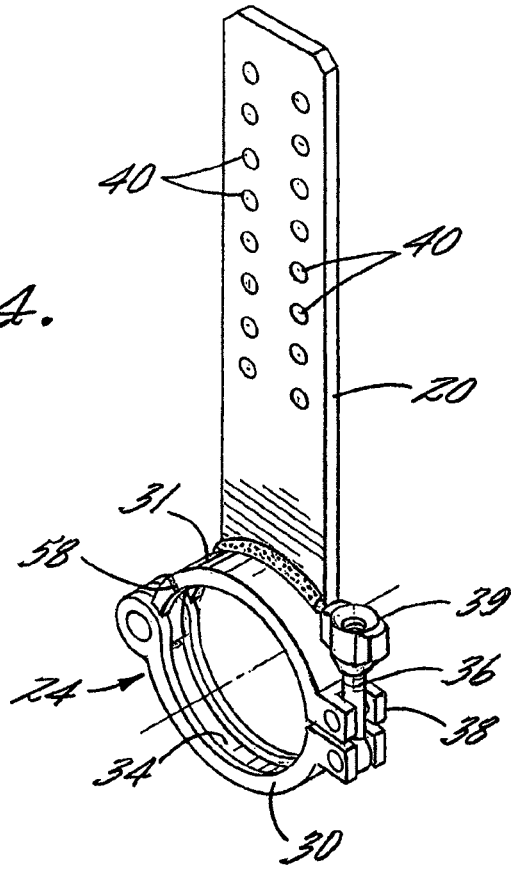
FIG. 4 is a perspective view of the clamp and arm of the mounting assembly of FIG. 1.

The inside surface of the clamp 24 has a generally circular configuration when in the closed position and the outside surface of the hub has a complementary circular configuration (see FIGS. 2-4). The complementary geometries of the inside surface of the clamp 24 and the outside surface of the hub 22 enable the hub to be arranged on the radial inside of the clamp, i.e. with the clamp in surrounding relation to the hub. In this case, the hub 22 includes a radially outward extending rim 32 (see FIG. 3) that is received in a groove 34 in the inside surface of the clamp 24 (see FIG. 4). When the clamp 24 is in the closed position, this rim 32 is captured in the clamp groove 34 such that the hub 22 cannot move axially relative to the clamp 24. However, the hub 22 is free to rotate relative to the clamp 24, at least until the clamp is tightened, as described in greater detail below.

For securing the clamp 24 in the closed position, the illustrated clamp includes a swinging latch 36 (see FIGS. 2 and 4). The latch 36 is pivotally connected to one of the parts of the clamp 24 and is receivable in a bracket 38 carried on the other part of the clamp. In this case, the latch 36 is threaded and carries a nut 39. To close and secure the clamp 24, the latch 36 is pivoted into the bracket 38 and then the nut 39 is tightened down on body of the latch and into engagement with the bracket 38. Once the nut 39 engages the bracket 38, further tightening of the nut draws the ends of the two parts of the clamp 24 together and tightens the clamp down on the hub 22 securing it within the clamp and locking the hub against further rotation relative to the clamp. The clamp 24 can comprise a standard, commercially available sanitary clamp which is in common usage in the pharmaceutical industry. One supplier of appropriate sanitary clamps is WCB-Flow Products of Buffalo, N.Y.

For facilitating connecting the clamp and hub assembly 18 to available support structures, in the illustrated embodiment, the clamp and hub assembly is attached to the end of an arm 20. For example, in this case the second part 31 of the clamp 24 is secured to the end of the arm 20 such as by welding. The first part 30 of the clamp 24 is, in turn, pivotable relative to the second part 31 and the arm 20. Beginning adjacent the end opposite the end where the clamp 24 is attached, the arm 20 includes a plurality of mounting holes 40. In this case, the mounting holes 40 are arranged in a plurality of rows with each row having a pair of mounting holes 40 and with each pair being spaced a different distance from the end of the arm 20.

Figure 5:
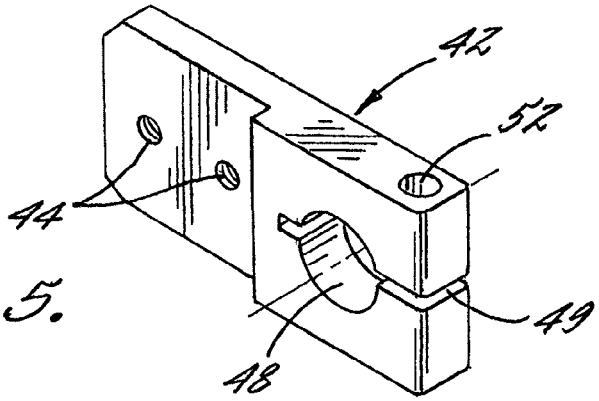
FIG. 5 is a perspective view of the mounting bracket of the mounting assembly of FIG. 1.
Figure 5A:
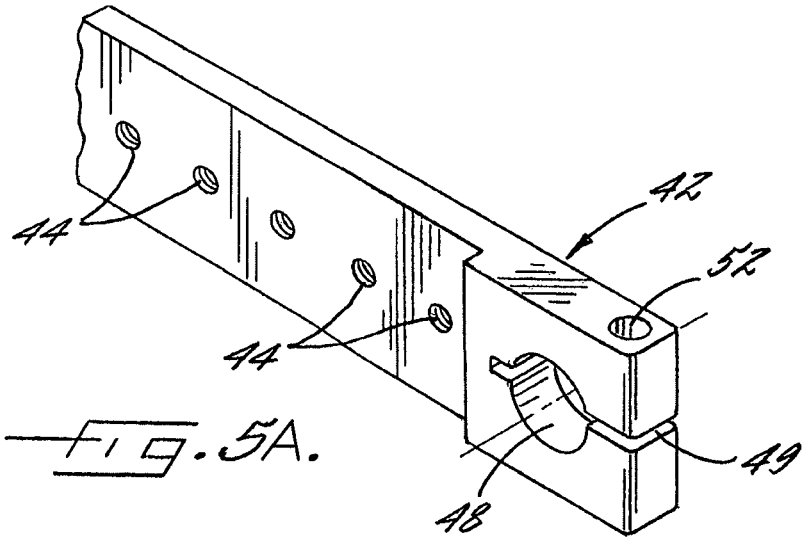
FIG. 5A is a perspective view of an alternative embodiment of the mounting bracket for the mounting assembly shown in FIG. 1.

These mounting holes 40 allow the arm 20 to be connected to a mounting bracket 42. Specifically, in the illustrated embodiment shown in FIG. 5, the mounting bracket 42 includes a pair of complementary threaded mounting holes 44. Thus, the arm 20 can be connected to the mounting bracket 42 by aligning one of the pairs of the mounting holes 40 on the arm 20 with the pair of mounting holes 44 on the mounting bracket 42 and then connecting the two components with appropriate bolts 45 inserted through the aligned holes. Because the arm 20 includes a plurality of mounting holes 40, the clamp and hub assembly 18 can be placed in a variety of different positions relative to the mounting bracket 42 by using different pairs of the plurality of mounting holes 40 provided on the arm 20 to connect to the mounting holes 44 on the mounting bracket 42. This flexibility in the positioning of the clamp and hub assembly 18 relative to the mounting bracket 42 allows the mounting assembly 16 to be easily tailored to different applications including existing equipment where the mounting assembly is being installed as a retrofit. In order to provide additional flexibility with regard to the relative positioning of the arm 20 and mounting bracket 42, the mounting bracket 42 could also have a plurality of mounting holes which, like those provided on the arm, would correspond to different mounting positions as shown in FIG. 5A.

In this case, the mounting bracket 42 is configured to attach to a mounting structure that may already be associated with the application. For example, the mounting structure may be a rod or bar that is either already provided in the application equipment (e.g., the coating machine) or that can be installed in the equipment. To enable the connection to the mounting structure, one end of the illustrated mounting bracket 42 includes an opening 48 that corresponds in shape to the cross-sectional configuration of the mounting structure. The illustrated embodiment is intended for use with a round mounting bar, as shown in FIG. 1, so opening 48 in the mounting bracket 42 is generally circular with a diameter slightly larger than the diameter of the mounting bar. The mounting bracket further includes a slot 49 that communicates with the opening 48 and extends to the end of the mounting bracket 42 so as to allow the bracket to flex somewhat to facilitate placement of the mounting bracket over the mounting bar. Once the mounting bracket 42 is placed over the mounting bar, the mounting bracket 42 can be tightened down on the bar using a bolt 50 (see FIG. 1) that is receivable in a complementary hole 52 (see FIG. 5) that extends laterally through the end of the mounting bracket across the slot 49. When the bolt 50 is tightened, the portions of the mounting bracket 42 on opposite sides of the slot 49 are drawn towards each other so as to reduce the circumference of the opening and thereby tightening the mounting bracket 42 down on the mounting bar.

To attach the clamp and hub assembly 18 to the manifold 10 and in particular to one of the support assemblies 14 of the manifold, the two halves 26, 27 of the hub 22 are first joined around the outside surface of the support assembly 14. To this end, when assembled, the inside surface of the hub 22 has a configuration that corresponds to the cross-sectional configuration of the support assembly 14. In this case, the support assemblies 14 have a generally rectangular cross-sectional configuration with beveled corners, accordingly the inside surface of the hub 22 has a corresponding configuration. Once the two halves 26, 27 of the hub 22 are assembled on the support assembly 14, the two halves can be loosely secured together using two bolts 28 that are in respective mounting holes in the two halves of the hub 22. The hub 22 can then be slid along the support assembly 14 until it is aligned with the clamp 24, which typically is mounted first on the mounting bar via the arm 20 and mounting bracket 42. When in the proper position, the two mounting bolts 28 for the hub 22 can be tightened down to lock the hub in position on the support assembly 14. The manifold 10 and hub 22 are then inserted into the clamp 24 with the rim 32 of the hub received in the groove 34 in the inside surface of the clamp and the clamp is then closed. These steps can be used for both of the mounting assemblies 16 included in the illustrated embodiment.

Before the clamp latches 36 are tightened down, the manifold 10 can be rotated about its longitudinal axis until the spray gun modules 12 are discharging in the desired direction. As noted above, this rotation is possible because the hub 22 is rotatable relative to the clamp 24. Once the manifold 10, and in particular the spray gun modules 12, are in the desired orientation, the latches 36 can be tightened down so as to secure the hubs 22, and with it the manifold 10, in position. If an operator wants to later change the angular orientation of the spray modules 14, for example, because a different product is going to be run through the coating machine, the operator only has to loosen the latches 36 of the clamps 24 so that the hubs 22 can again rotate in the clamp. The operator can then turn the manifold 10 about its longitudinal axis until the spray modules 12 are in the desired new position. Once the new position is reached, the clamps 24 can be tightened down again using the latches 36. Similarly, when it becomes necessary to clean or otherwise service the manifold 10, the hubs 22 just have to be released from the clamps 24 and the manifold can be removed from the mounting arrangement.

In this case, the hub 22 is a separate element from the clamp 24 that is assembled to the manifold support assembly 14 before the clamp is arranged over the hub. However, it is possible to provide a clamp and hub assembly 18 that has a hub that is essentially permanently connected to the clamp while the hub maintains the ability to rotate relative to the clamp.

The position of the manifold 10 along its longitudinal axis can also be adjusted by, for example, releasing the clamps 24 and then loosening the hubs 22 so that they can slide along the respective support assembly 14. Once the hubs 22 are in their desired new positions they can again be tightened down and the hubs 22 and manifold 10 reinserted into the clamps 24. Another way to adjust the position of the manifold 10 along its longitudinal axis would be loosen the mounting brackets 42 so that the whole mounting arrangement 16 can be slid along with the manifold 10 along the mounting bar. Once the manifold 10 is in the desired new position, the mounting brackets 42 can be re-tightened down on the mounting bar. As discussed above, the lateral spacing of the manifold 10 relative to the mounting bar can be adjusted by using a different pair of mounting holes 40 to attach the arm 20 to the mounting bracket 42.

For facilitating rotation of the manifold 10 into the desired position, the hub and clamp assembly 18 can respectively be provided with indexing marks 54 that can be used to signify that the hub 22 and the clamp 24 are in specified relative positions. In the illustrated embodiment, the hub 22 has a plurality of indexing marks 54 on the outer circumferential surface of a flange 56 (see FIG. 3) that extends axially away from the rim 32 that is captured in the groove of the clamp. The indexing marks 54 are arranged on the flange 56 and the hub 22 is configured in such a manner that the indexing marks 54 are visible when the hub 22 is arranged in the clamp 24. The indexing marks 54 in this case correspond to ten degree increments between 0° and 90° around the circumference of the hub 22.

A corresponding reference mark 58 can be provided on the clamp 24 (see FIG. 4) with which the indexing marks 54 on the hub 22 can be aligned. As will be appreciated, these marks 54, 58 allow the hub 22 and manifold 10 to be rotated relative to the clamp 24 into precise positions quickly and easily. The marks 54, 58 also make it easy to accurately return the manifold 10 and hub 22 into a particular position when specific products are being coated. For instance, when coating a specific pharmaceutical product it may be desired to have manifold 10 and hub 22 at an angular position of 20° relative to the clamp 24. Thus, when setting up the manifold 10 to process that pharmaceutical product, the operator can quickly turn the manifold 10 and hub 22 relative to the clamp 24 until the 20° index mark 54 aligns with the reference mark 58 on the clamp 24. Those skilled in the art will appreciate that indexing marks are not necessary to practice the invention and that other types of indexing systems could be used to measure the position of the manifold and hub relative to the clamp.

In view of the foregoing, a mounting assembly is provided that allows the position of the spray gun manifold to be adjusted quickly and easily. Moreover, the mounting assembly allows the position and orientation of the manifold to be adjusted across a wide range providing added flexibility that is useful when adapting the manifold and mounting arrangement to different applications, including existing equipment. The mounting assembly is also easily assembled and disassembled thus facilitating service and cleaning operations.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spraying apparatus for mounting on a mounting structure comprising a spray manifold including a plurality of spray devices arranged in an array in laterally spaced relation to each other;

a plurality of identical support assemblies with one support assembly being arranged between each adjacent pair of spray devices for supporting the spray devices relative to each other, said support assemblies each having an outer periphery of a non-circular configuration and including at least one fluid conduit for communicating fluid between adjacent spray devices in the lateral array;

at least one mounting assembly for supporting said spray manifold in predetermined relation to the mounting structure, said mounting assembly including a hub, said hub including a pair of hub parts that are selectively positionable laterally along said support assemblies, said hub parts defining a non-circular inner configuration corresponding to the non-circular outer configuration of said support assemblies positioned about one of the support assemblies, said hub having at least one fastener for releasably fixing said hub at a selected position along said support assemblies, said hub parts defining a circular outer configuration, said mounting assembly further including a clamp supported by said mounting structure, said clamp having a pair of clamping arms, said mounting assembly further including a support arm for supporting said clamp in predetermined relation to said mounting structure, one of said clamping arms being disposed in fixed relation to said support arm, and the other of said clamping arm being mounted for pivotal movement relative to said support arm and one clamp arm, said clamping arms defining a circular inner configuration complementary to an outer configuration of said hub for permitting selective relative rotational movement of said hub with respect to said clamping arms, said outer configuration of said hub and inner configuration of said clamping arms further defining a cooperating annular groove and rib that permit selected relative rotational movement of said hub with respect to said clamp while preventing relative axial movement for enabling angular orientation of the spray manifold and spray devices thereof relative to the mounting structure, and said clamp having a releasable fastener for securing said clamping arms in fixed relation about said hub for securing said hub and manifold in predetermined angularly oriented position with respect to said clamp and mounting structure.

2. The spraying apparatus of claim 1 in which said hub and clamp have indexing indicia at circumferential locations in a relation to said circular configuration of said clamping arms for facilitating selected predetermined rotational positioning of said hub relative to said clamp.

3. The spraying apparatus of claim 1 in which said mounting structure includes a mounting bracket that includes a pair of mounting holes, and said support arm is being formed with a plurality of pairs of mounting holes at spaced intervals, each said pair of support arm mounting holes being complementary to said mounting bracket mounting holes for permitting securement of said support arm to said bracket by use of fasteners that cooperate with said mounting bracket holes a selected pair of support arm holes for locating the manifold a selected distance from said mounting structure.

4. A spraying apparatus for mounting on a mounting structure comprising a spray manifold including a plurality of spray devices arranged in an array in laterally spaced relation to each other;

a plurality of identical support assemblies with one support assembly being arranged between each adjacent pair of spray devices for supporting the spray devices relative to each other, said support assemblies each having an outer periphery of a non-circular configuration and including at least one fluid conduit for communicating fluid between adjacent spray devices in the lateral array;

at least one mounting assembly for supporting said spray manifold in predetermined relation to the mounting structure, said mounting assembly including a hub, said hub including a pair of hub parts that are selectively positionable laterally along said support assemblies, said hub parts defining a non-circular inner configuration corresponding to the non-circular outer configuration of said support assemblies positioned about one of the support assemblies, said hub parts defining a circular outer configuration, said mounting assembly further including a clamp supported by said mounting structure, said clamp having a pair of clamping arms, one of said clamping arms being mounted for pivotal movement with respect to the other, said clamping arms defining a circular inner configuration complementary to an outer configuration of said hub parts for permitting selective relative rotational movement of said hub with respect to said clamping arms, and said hub and clamp have indexing indicia at circumferential locations in a relation to said circular inner configuration of said clamping arms for facilitating selected predetermined rotational positioning of said hub relative to said clamp for angularly positioning the spray manifold and spray devices in predetermined relation relative to the mounting structure.

* * * * *